United States Patent [19]

Duerig et al.

[11] Patent Number: 4,640,806

[45] Date of Patent: Feb. 3, 1987

[54] PROCESS FOR ATOMIZING LIQUID METALS TO PRODUCE FINELY GRANULAR POWDER

[75] Inventors: Thomas Duerig, Fremont, Calif.; Marcel Escudier, Mönthal; Jakob Keller, Killwangen, both of Switzerland

[73] Assignee: BBC Brown, Boveri & Company, Limited, Baden, Switzerland

[21] Appl. No.: 782,688

[22] Filed: Oct. 1, 1985

Related U.S. Application Data

[62] Division of Ser. No. 583,691, Feb. 27, 1984, Pat. No. 4,575,325.

[30] Foreign Application Priority Data

May 3, 1983 [CH] Switzerland ..... 2389/83

[51] Int. Cl.[4] ..... B22F 9/08

[52] U.S. Cl. ..... 264/9; 75/0.5 C; 264/12; 264/23; 425/7

[58] Field of Search ..... 264/9, 12, 23; 425/7; 75/0.5 C

[56] References Cited

U.S. PATENT DOCUMENTS

| | | | |
|---|---|---|---|
| 2,510,574 | 6/1950 | Greenhalzh | 264/9 |
| 2,997,245 | 8/1961 | Nilsson et al. | 264/22 |
| 4,369,919 | 1/1983 | Beloev et al. | 239/79 |

FOREIGN PATENT DOCUMENTS

| | | | |
|---|---|---|---|
| 961773 | 6/1964 | United Kingdom | 239/82 |

*Primary Examiner*—Donald Czaja
*Assistant Examiner*—Mary Lynn Fertig
*Attorney, Agent, or Firm*—Oblon, Fisher, Spivak, McClelland, & Maier

[57] ABSTRACT

Very finely granular metal powders are produced by atomizing a liquid jet of metal by means of a gas jet which, in addition to a continuous band of sound frequencies, contains at least one discrete sound frequency which is at least 5 decibel above the average intensity of this band, and which is generated in a rotationally symmetrical device by means of a nozzle (4) which has the shape of a hollow cone and by means of an annular resonance space (7) with an annular edge (6) and is projected concentrically against the liquid jet of metal at a total opening angle of an average 35° to 55°. The atomization zone of the gas jet should preferably contain at least three discrete sound frequencies which are each at least 10 decibel above the sound intensity of the continuous band.

4 Claims, 3 Drawing Figures

PROCESS FOR ATOMIZING LIQUID METALS TO PRODUCE FINELY GRANULAR POWDER

This is a division of application Ser. No. 583,691, filed Feb. 27, 1984, now U.S. Pat. No. 4,575,325.

BACKGROUND OF THE INVENTION

The starting point for the invention is a process as generically categorised in the preamble of claim 1.

The atomisation of metals for the purpose of producing a powder for powder-metallurgical and other applications has been publicised for a long time and is known from an extensive technical literature. Of the possible processes, the atomisation process using a gas jet (air, nitrogen or noble gas) is favoured. A known device for gas jet atomisation possesses, as an essential component, a centrally symmetrical body for guiding the liquid metal to be atomised (metal jet) and the atomising gaseous medium (gas jet), a so-called nozzle (cf. for example U.S. Pat. No. 2,997,245). A device of this type is intended to spread the liquid metal jet as completely as possible into individual small droplets.

In powder metallurgy, then, there are applications where it would appear to be desirable to increase to extremely high values the rate of cooling during the solidification of the droplets, in order to realise very specific, controlled structures. In particular, the intention is in this way to avoid segregations out of saturated or supersaturated melts and to obtain homogeneous structures. That in turn necessitates a special device which enables very well defined gas-dynamic conditions to be realised in the atomisation zone. The existing devices and nozzles satisfy these conditions only inadequately, if at all.

There is therefore a great need to improve existing metal atomisation devices and methods in such a way that the abovementioned effects can be removed as far as possible.

SUMMARY OF THE INVENTION

It is the object of the invention to specify a device, and a process, for atomising liquid metals with which it is possible to obtain extremely high cooling rates for the melts and extremely finely granular powder particles and in which the gas-dynamic conditions in the atomisation zone shall be optimised in order to ensure an as complete as possible disintegration of the metal.

BRIEF DESCRIPTION OF THE DRAWINGS

The invention is described by reference to the following illustrative embodiment depicted in Figures, of which:

FIG. 1 depicts a schematic longitudinal section through a device for atomising liquid metals. 1 is a rotationally symmetrical housing with preferably cylindrical confining surfaces. The housing 1 has an annular cooling duct 2 for holding a liquid or gaseous cooling agent. In the middle part of the housing 1 there is provided an annular chamber 3 which serves to supply the gas (atomising agent). The chamber 3 turns into a narrow conically shaped annular nozzle 4 which runs coaxially with the longitudinal axis of the housing 1. On the exit side of the annular nozzle 4, the housing 1 terminates in a stepped flange (end plate) 5 which has on its inner (bore) side a sharp annular edge 6 as well as an annular resonance space 7. In the central longitudinal bore of the housing 1 is a sleeve 8 whose exit end has a conical taper and a sharp exit edge 9. The sleeve 8, which is provided with a bore 10 for receiving the liquid metal to be atomised, has at its inlet end a thread 11 via which it is attached, by means of a round nut 12, to the housing 1. By means of this mechanism, the sleeve 8 is shiftable in its longitudinal direction relatively to the housing 1 and can thus be clamped into position in any relative position to the latter. In particular, its exit edge 9 can thereby be varied relative to the position of the annular nozzle 4 and the annular edge 6. The building elements 1, 5, 8 and 12 are advantageously made of metallic materials having graded hot strength and different thermal conductivities. Depending on the melting point of the metal to be atomised, however, the sleeve 8, in particular, can also consist of a heat-resistant material, such as, for example, ceramic material. However, the invention is not in any way tied to a specific material; its characteristic geometry can in principle be applied to any suitable combination of materials.

FIG. 2 shows a longitudinal section through an atomisation zone of the device on a larger scale. The reference marks correspond exactly to those of FIG. 1. In FIG. 2 it can be seen in particular that the exit edge 9 of the sleeve 8 is advantageously set back relative to the imaginary continuation of the conical, moving surface of annular nozle 4, so that the exit cone of the sleeve 8 is not in line with the cone of the annular nozzle.

FIG. 3 depicts a diagram pertaining to the gasdynamic conditions in the atomisation zone. The sound intensity in decibel is plotted as a function of frequency in kHz. Nitrogen under a pressure of 80 bar was used as the atomising means.

DETAILED DESCRIPTION OF THE INVENTION

Figure 1:
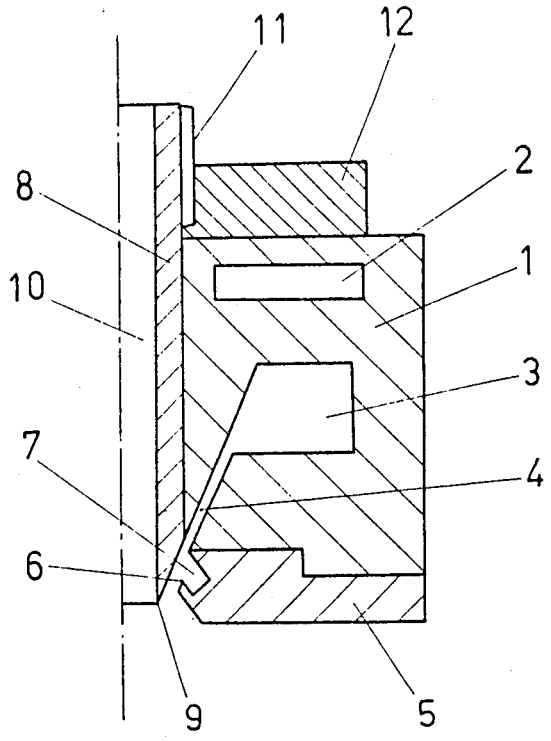
FIG. 1 shows a schematic longitudinal section through a device for atomising liquid metals.
Figure 2:
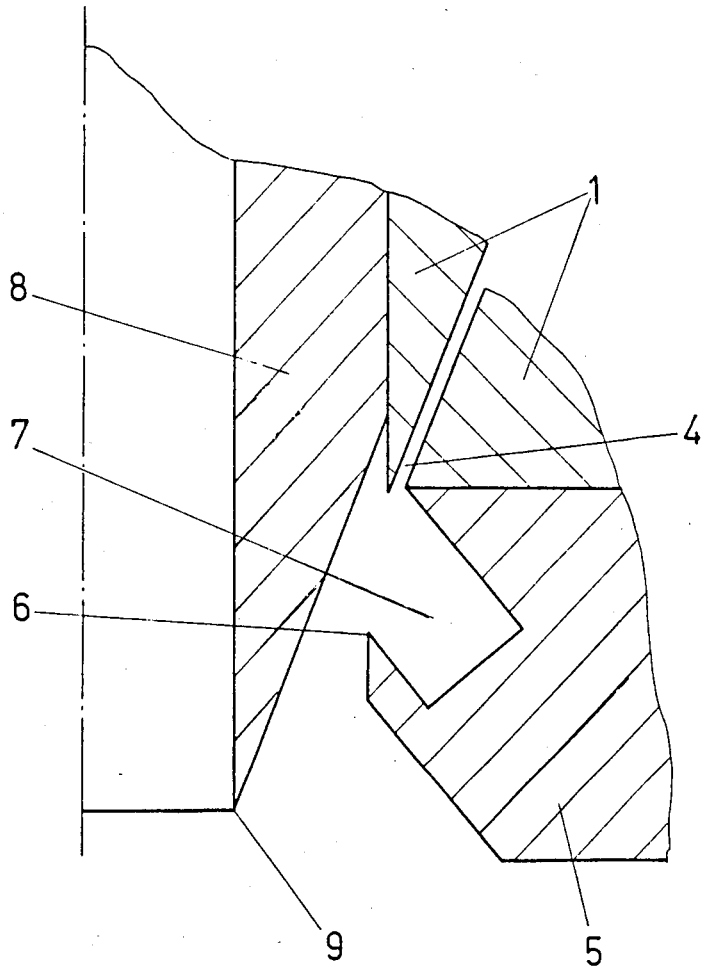
FIG. 2 shows a longitudinal section through the atomisation zone of the device depicted in FIG. 1 on a smaller scale.
Figure 3:
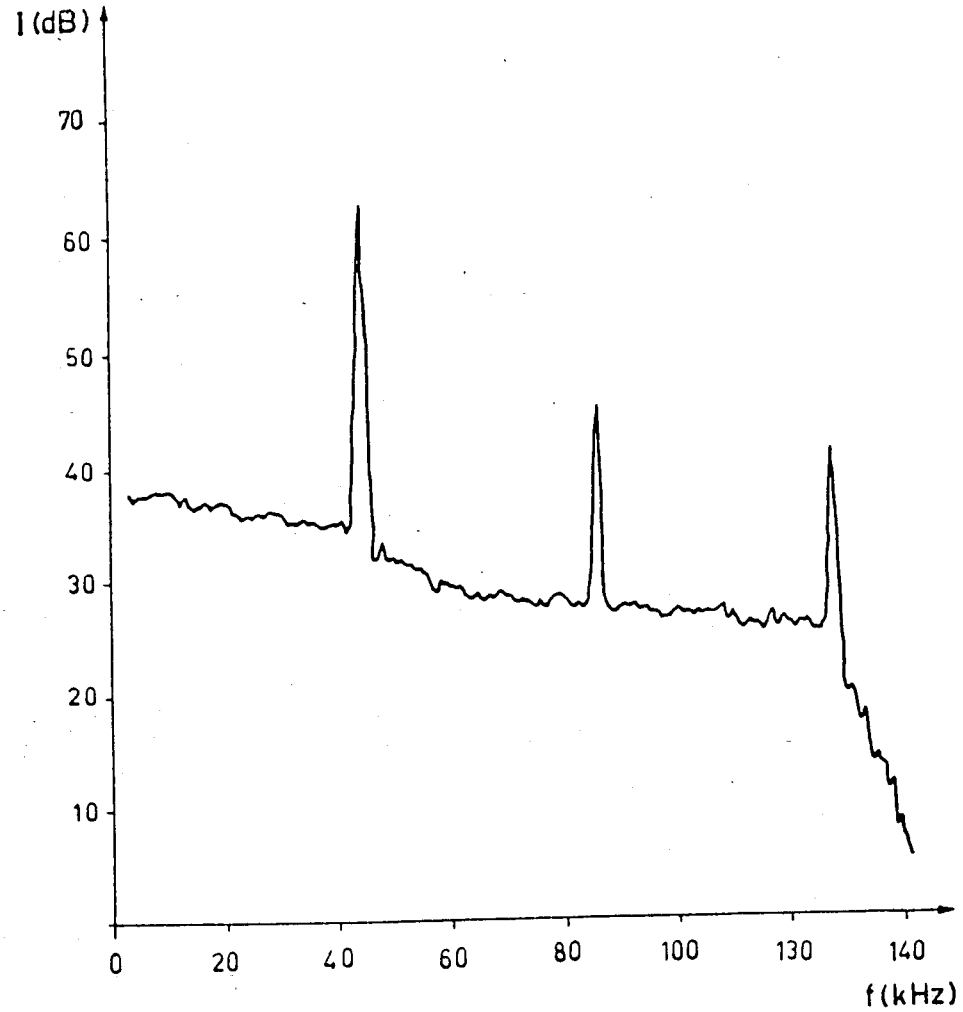
FIG. 3 shows a diagram of the gas-dynamic conditions in the atomisation zone: sound intensity of the gas jet as a function of frequency.

Building elements 1, 5, 8 and 12 as in FIG. 1 were made of steel, the actual dimensions being about half those drawn in FIG. 1. The sleeve 8 was adjusted in such a way that its exit edge 9 was set back about 1.2 mm from the imaginary section of the extension of the cone surface corresponding to annular nozzle 4 with the surface of the cylindrical bore 10 of the sleeve 8 (see FIG. 2). The annular cooling duct 2 of the housing 1 was cooled with water, while the annular chamber 3 serving the gas supply was subjected to nitrogen under 80 bar pressure as atomising means. As is clear from the diagram in FIG. 3, there were, in addition to an approximately continuous frequency band with an average sound intensity of about 30 decibel, which should be interpreted as "noise", three further, characteristic discrete frequencies in the ultrasound range at about 40, 80 and 130 kHz, which were about 15 to 25 decibel more intense than the continuous band. These discrete "tones" can be used in the main for the advantageous disintegration mechanism in the atomisation zone of the liquid metal.

The invention goes beyond the description of Figures as well as the abovementioned illustrative embodiment. In carrying out the process, it is essential that there is at least one discrete sound frequency whose intensity is at least 5 decibel above the average of the continuous band, and the pressure amplitude should at least reach the same value as the stationary pressure of the driving gas used for producing the gas jet. The driving gas need not be nitrogen but can also be a noble gas, for example argon or helium. Advantageously there should be at least three discrete sound frequencies which are within the frequency range from kHz up to about 200 kHz and the sound intensity of which is at least 10 decibel above that of the continuous band. The average total opening angle of the imaginary cone of the gas jets should be about 35 to 55°.

The advantageous effect of the new atomising device consists in the generating of a gas jet which moves at at least the speed of sound against the liquid metal jet and which, in addition to a more or less continuous band, possesses clearly noticeable discrete high-intensity sound frequencies. This effect is achieved through a special design of a resonance space and through controlled guidance of the gas jets.

We claim:

1. An improved process for atomizing liquid metals to produce a finely granular powder by disintegrating a jet of liquid metal by means of a gas jet running concentrically with the jet of liquid metal, said gas being directed towards the interior of the jet of liquid metal, forming an enveloping sheath, being annular and having superposed sound vibrations, said improved process being characterized in that the gas jet, in addition to having a continuous band of sound frequencies, contains at least one more discrete sound frequency whose intensity is at least 5 decibel above the average of that of the continuous band and whose pressure amplitude reaches at least the same level as the static stationary pressure of the driving gas used for producing the gas jet.

2. A process according to claim 1, characterized in that the gas jet is guided fanlike about an imaginary cone surface towards the latter's tip and towards the axis of the jet of liquid metal, said cone having an opening angle of 35 to 55°, and said gas jet contains at least three discrete sound frequencies within the frequency range from 10 kHz to 200 kHz, whose sound intensity is at least 10 decibel higher than that of the continuous band.

3. A process according to claim 1, characterized in that said gas is selected from the group consisting of nitrogen, argon and helium.

4. A process according to claim 1, characterized in that said gas jet moves at at least the speed of sound against said jet of liquid metal.

* * * * *